US006378481B1

(12) United States Patent
Conradty et al.

(10) Patent No.: US 6,378,481 B1
(45) Date of Patent: Apr. 30, 2002

(54) FOUR-STROKE INTERNAL COMBUSTION ENGINE WITH A ROTARY-SPOOL VALVE

(76) Inventors: Christoph Conradty, Suedliche Auffahrtsalle 15, D-80639 Muenchen; Sven Glocke, Reitmorstrasse 19, D-80538 Muenchen, both of (DE)

( * ) Notice: Subject to any disclaimer, the term of this patent is extended or adjusted under 35 U.S.C. 154(b) by 0 days.

(21) Appl. No.: 09/685,319

(22) Filed: Oct. 10, 2000

(30) Foreign Application Priority Data

Oct. 15, 1999 (DE) ..... 199 49 857

(51) Int. Cl.[7] ..... F01L 7/00
(52) U.S. Cl. ..... 123/190.2; 123/80 BA
(58) Field of Search ..... 123/190.1, 190.2, 123/80 R, 80 BA, 193.6

(56) References Cited

U.S. PATENT DOCUMENTS 5,273,004 A * 12/1993 Duret ..... 123/190.2

FOREIGN PATENT DOCUMENTS

| | | |
|---|---|---|
| DE | 43 02 648 A1 | 8/1994 |
| DE | 44 24 117 | 1/1995 |
| DE | 196 38 024 | 3/1998 |
| DE | 694 16 072 | 9/1999 |
| EP | 635 095 | 1/1995 |
| EP | 856 649 | 8/1998 |
| FR | 2 662 214 | 11/1991 |
| FR | 2 678 319 | 12/1992 |
| GB | 2106592 | * 4/1983 |
| WO | WO93/18283 | 9/1993 |

* cited by examiner

*Primary Examiner*—Noah P. Kamen
(74) *Attorney, Agent, or Firm*—Flynn, Thiel, Boutell & Tanis, P.C.

(57) ABSTRACT

In a four-stroke internal combustion engine with a rotary-spool valve as the inlet valve, the cylinder head has a valve shaft supported transversely with respect to the cylinder axis, which valve shaft has a passage extending inclined with respect to the shaft axis and rotates at half of the speed of the crankshaft of the engine. A channel is furthermore provided in the cylinder head, which channel leads to the valve shaft. A fuel-injection nozzle is arranged in the channel, a jet axis of which nozzle is directed toward the opening provided between valve shaft and an internal-combustion chamber. The fuel-injection nozzle emits a fuel jet directly to the opening when the opening is openly communicating with the passage.

6 Claims, 3 Drawing Sheets

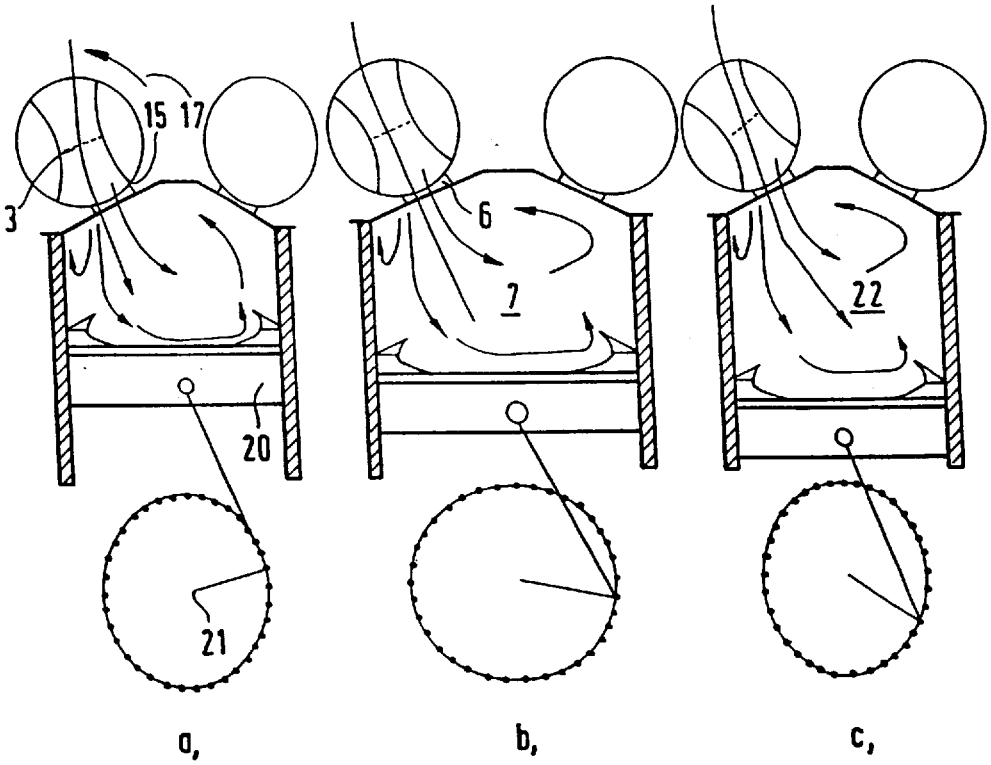
FIG.5
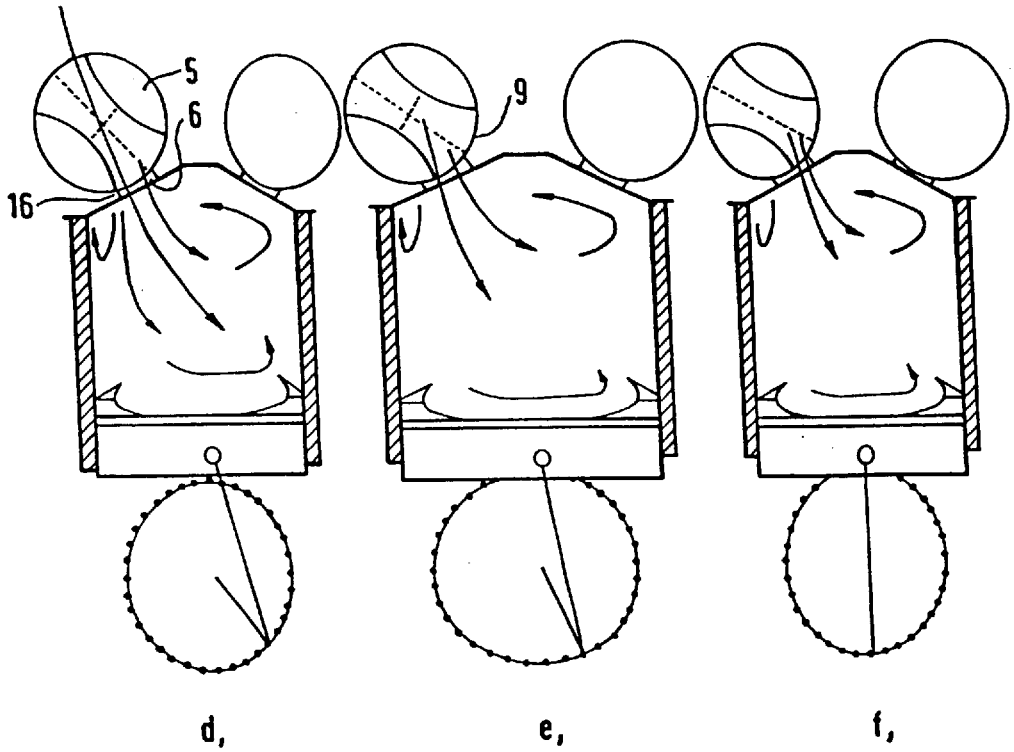

FOUR-STROKE INTERNAL COMBUSTION ENGINE WITH A ROTARY-SPOOL VALVE

FIELD OF THE INVENTION

The invention relates to a four-stroke internal combustion engine with a rotary-spool valve.

BACKGROUND OF THE INVENTION

Such an engine is the subject matter of the European Patent EP 0 635 095 B1. The there described rotary-spool valve has the advantage that long valve-open times are achieved, which extend beyond more than 180 crankshaft degrees. Thus, an optimum filling of the combustion chamber during the suction stroke is achieved.

In this four-stroke internal combustion engine it is assumed that a conventionally produced air-fuel mixture is fed to the combustion chamber through the inlet valve. This air-fuel mixture is usually produced by a carburetor.

The French patent FR 26 62 214 describes a two-stroke internal combustion engine with a rotary-spool valve, having a fuel-injection nozzle arranged in a channel between a compressor and the valve shaft. The fuel spray, or jet, of the injection nozzle is directed toward a lead aperture of a valve shaft passage when the passage connects the channel to an opening leading to the combustion chamber. This passage is, however, three-dimensionally curved so that the fuel cannot directly enter into the combustion chamber. Instead the droplets from the fuel jet are carried along by the air compressed by a compressor.

SUMMARY OF THE INVENTION

The purpose of this invention is to provide a design for a four-stroke internal combustion engine having a rotary-spool valve of the abovementioned type capable of injecting fuel into the combustion chamber. More specifically, in a four-stroke internal combustion engine with a rotary-spool inlet valve, the cylinder head has a valve shaft supported transversely with respect to the cylinder axis. The valve shaft has a passage extending inclined with respect to the shaft axis and rotates at half of the speed of the crankshaft of the engine. A channel is furthermore provided in the cylinder head that leads to the valve shaft. A fuel-injection nozzle is arranged in the channel so that a jet axis of the nozzle is directed toward an opening provided between the valve shaft and an internal-combustion chamber. The fuel-injection nozzle emits a fuel jet directly into the opening when the opening is openly communicating with the passage.

BRIEF DESCRIPTION OF THE DRAWINGS

One exemplary embodiment will be discussed in greater detail hereinafter in connection with the drawings, in which:

FIG. 5 illustrates various phases of the inlet cycle.

DETAILED DESCRIPTION

Figure 2:
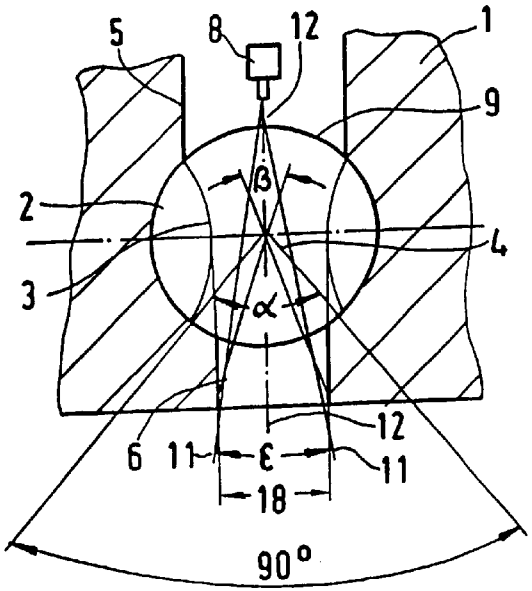
FIG. 2 is a vertical cross-sectional view according to FIG. 1 in a plane extending at a right angle with respect to the valve-shaft axis.
Figure 1:
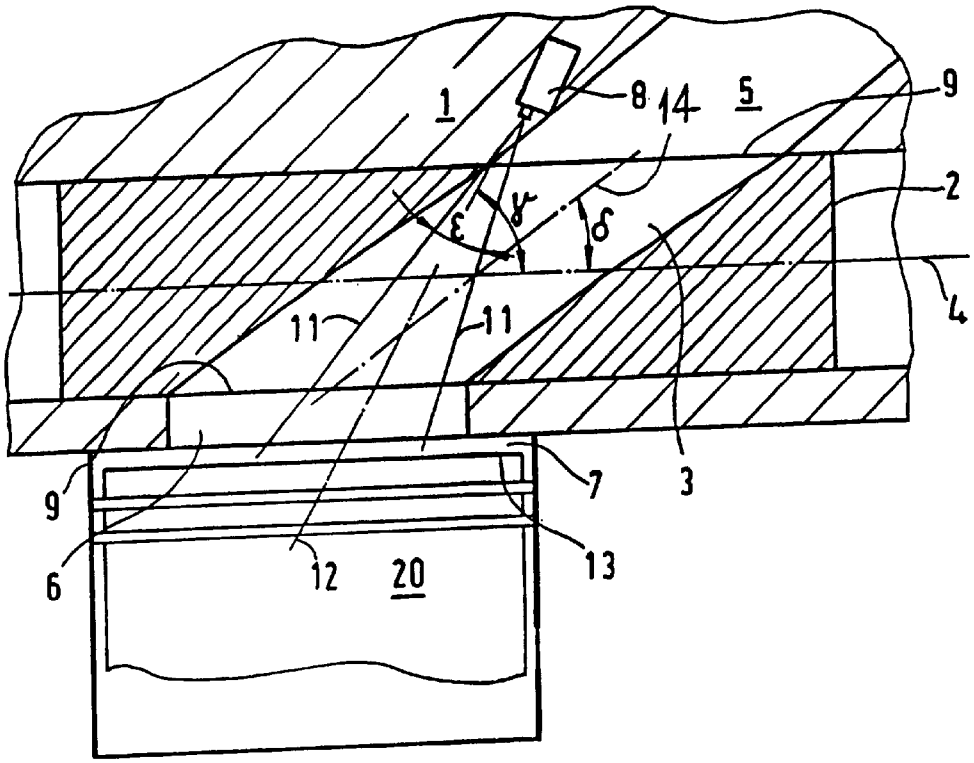
FIG. 1 is a vertical cross-sectional view of the upper part of a cylinder in a plane which extends through the valve-shaft axis.
Figure 3:
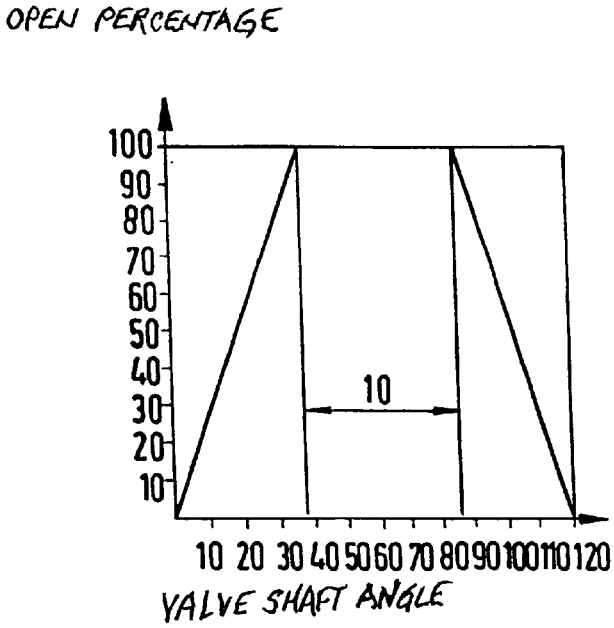
FIG. 3 illustrates a diagram of the valve-opening pattern.

A valve shaft 2 is rotatably supported in a cylinder head 1. The valve shaft rotates at half of the speed of the crankshaft 21. This valve shaft 2 includes a passage 3, which functions as an inlet and extends at an angle with respect to the valve-shaft axis 4. During one rotation of the valve shaft 2 the passage 3 connects a channel 5 in the cylinder head 1 leading to the valve shaft 2 to an opening 6 in the cylinder head 1 extending from the valve shaft 2 to the internal-combustion chamber 7 of the cylinder. A fuel-injection nozzle 8 is arranged in the wall of the channel 5. As illustrated in FIG. 2, the angular range $\alpha$ of the lead aperture 9 is approximately 90°, whereas the angular range $\beta$ of the opening 6 is approximately 35°. This difference in angular ranges results in the pattern of opening and closing of the valve illustrated in FIG. 3.

This means that the valve is opening through an angle of rotation of the valve shaft 2 of approximately 35°, subsequently is open fully through an angular range of approximately 50°, and the valve is closing through a further angle of rotation of approximately 35°. The fully opened angular range of the valve is identified with reference numeral 10 in FIG. 3.

The injection nozzle 8 creates a conical fuel jet 11, the axis of which is identified by the reference numeral 12. This fuel jet 11 is directed toward the surface 13 of the cylinder 20. The jet 11 is oriented such that its axis 12 assumes an angle $\gamma$ with respect to the axis 4, which is larger than the angle $\delta$ which the passage axis 14 assumes with respect to the axis 4. This refers to the case when the axes 4, 12 and 14 lie in one common plane.

The angle of opening $\Sigma$ of the jet 11 is approximately 20° in the illustrated exemplary embodiment, thus it has a width in the area of the opening 6 that is slightly less than the width 18 of the opening 6. The jet 11 can thus enter unhindered from the injection nozzle 8 through the passage 3 and the opening 6 into the internal-combustion chamber 7.

The injection is supposed to take place within the range of rotation 10 of the valve shaft 2. The injection area is approximately the area illustrated in FIGS. 5*a* to 5*d*. The injection area starts when, viewed in direction of rotation 17 of the valve shaft 2, the front edge 15 of the passage has swept over the opening 6 and ends when the rear edge 16 starts to sweep over the opening 6.

Figure 4:
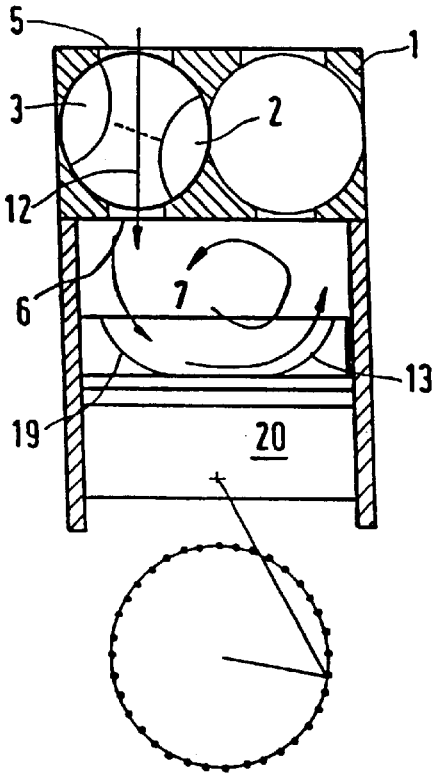
FIG. 4 is a cross-sectional view corresponding to FIG. 2 to illustrate a preferred piston form.

The piston surface 13 is preferably designed concavely according to FIG. 4, preferably in the form of an elliptic recess 19.

The duration of the injection can be varied, however, should take place within the angular range 10. It is furthermore possible to vary the amount of fuel supplied per unit of time during the injection.

When a piston design according to FIG. 4 is chosen, a turbulent vortex is formed in the center of the cylinder by the injection jet, which vortex depends on the spacing between piston and cylinder head. In the case of the piston, which is concave on both sides, a single well developed vortex 22 is created in the cylinder center, which improves the combustion process. Since the valve is open over a relatively long phase 10, a constant flow is created. When the valve is completely open, the efficiency of the flow corresponds with the geometry of the inlet, namely a flow separation does not take place. When the injection takes place with a fully open valve and when in particular a piston design as in FIG. 4 is chosen, a wetting of the walls of the cylinder does not take place. However, a strong impact of the jets on the piston surface 13 takes place. It is furthermore advantageous that work can be done with a relatively low injection pressure, and that the injection nozzle 8 is positioned outside of the hot combustion chamber 7.

What is claimed is:

1. A four-stroke internal combustion engine having a rotary-spool inlet valve positioned in a cylinder head and spaced apart from a combustion chamber that is adjacent the cylinder head, wherein the rotary-spool valve includes a valve shaft that has a shaft axis and is configured to rotate at half the speed of an engine crankshaft, the rotary spool inlet valve being supported transversely with respect to a cylinder axis of the cylinder head, a passage extends through the valve shaft and is oriented inclined with respect to the shaft axis, a channel in the cylinder head leads to the valve shaft, an opening in the cylinder head extends between the valve shaft and the combustion chamber, the passage having a lead aperture that sweeps over the opening as the valve shaft rotates, the lead aperture having an angular range ($\alpha$) about the shaft axis which is at least as large as an angular range ($\beta$) of the opening about the shaft axis, wherein the channel and the opening are connected by the passage only once during one full rotation of the valve shaft, a fuel-injection nozzle is positioned in the channel and has a jet axis which is aligned with the opening through an aligned passage in the valve shaft, the fuel injection nozzle being configured to emit a fuel jet directly into the opening when the opening is openly communicating with the lead aperture, and wherein the shaft axis, an axis of the passage, and the jet axis lie in one common plane, the jet axis being oriented at a first angle ($\gamma$) with respect to the shaft axis and a lead aperture axis being oriented at a second angle ($\delta$) with respect to the shaft axis, the first angle ($\gamma$) being larger than the second angle ($\delta$).

2. The four-stroke internal combustion engine according to claim 1, wherein the lead aperture and the opening are sized such that the sum of the angular range ($\alpha$) and the angular range ($\beta$) is larger than 90°, and a front edge of the lead aperture has swept over the opening prior to fuel injection and a rear edge of the lead aperture starts to sweep over the opening after the end of fuel injection.

3. The four-stroke internal combustion engine according to claim 1, wherein the valve shaft and the cylinder head are configured such that the passage starts to create a connection between the channel and the opening when the piston is in its top dead center position.

4. The four-stroke internal combustion engine according to claim 1, wherein a width of the fuel jet at an end of the opening adjacent the combustion chamber corresponds at a maximum with a width of the opening.

5. The four-stroke internal combustion engine according to claim 1, wherein a fuel jet impact area on the piston is a concave impact surface.

6. The four-stroke internal combustion engine according to claim 5, wherein the concave impact surface of the piston is an elliptic recess.

* * * * *